United States Patent [19]

Bunch et al.

[11] Patent Number: 4,989,350

[45] Date of Patent: Feb. 5, 1991

[54] ATHLETIC SHOE WITH CONTROL STRUTS

[75] Inventors: Richard P. Bunch, Reading; Steven S. Chapman, North Attleboro, both of Mass.; Theodore S. Gross, Stony Brook, N.Y.

[73] Assignee: Converse Inc., North Reading, Mass.

[21] Appl. No.: 308,062

[22] Filed: Feb. 8, 1989

[51] Int. Cl.[5] ..... A43B 7/14; A43B 7/20

[52] U.S. Cl. ..... 36/89; 36/114; 128/166

[58] Field of Search ..... 36/88, 89, 90, 114; 128/80 H, 166

[56] References Cited

U.S. PATENT DOCUMENTS

| | | | |
|---|---|---|---|
| 975,820 | 11/1910 | Azzara | 36/89 |
| 1,546,551 | 7/1925 | Petri | 36/89 |
| 2,444,428 | 7/1948 | Carrier | 36/89 |
| 2,972,822 | 2/1961 | Tanner | 36/89 |
| 3,268,912 | 8/1966 | Whelan | 36/89 |
| 3,613,273 | 10/1971 | Marquis | 36/89 |
| 4,719,926 | 1/1988 | Nelson | 36/89 |
| 4,809,686 | 3/1989 | Crane | 36/89 |

FOREIGN PATENT DOCUMENTS

| | | | |
|---|---|---|---|
| 1193946 | 11/1959 | France | 36/89 |
| 0662483 | 10/1987 | Switzerland | 36/89 |
| 22358 | of 1906 | United Kingdom | 36/89 |

*Primary Examiner*—Steven N. Meyers

*Attorney, Agent, or Firm*—Bromberg & Sunstein

[57] ABSTRACT

An athletic shoe having sheet springs being rigidly fixed below a portion of the springs corresponding to the wearers ankle. The springs being unaffixed to the upper above a wearers ankle allowing the upper portion of the spring to stand free of the side of the shoe.

14 Claims, 3 Drawing Sheets

ATHLETIC SHOE WITH CONTROL STRUTS

TECHNICAL FIELD

The present invention relates to athletic shoes, and more particularly to athletic shoes including control struts that restrain medial and lateral flexing of the ankle, but that permit flexing forwards and rearwards. Such shoes are particularly useful in activities and sports involving strenuous motions of the foot relative to the leg, such as basketball.

BACKGROUND OF THE INVENTION

Modern basketball shoes are required to be both lightweight and extremely flexible because of the range and speed of motions arising in use.

An example of basketball shoe design is shown in U.S. Pat. No. DES 262,751 issued to Wolf Anderie. The shoe includes a high-top upper having a cushioning portion commencing just below the ankle and extending over the lower portion of the leg at the ankle opening. Various other constructions are now in the art, ranging from an essentially unitary sheet panel covering the entire upper portion of the shoe, to diverse arrangements of textile sheet portions and leather reinforcement portions so as to firmly accommodate for allowing a proper distribution of stresses within. A common need of all such designs is to provide adequate support to the foot of the wearer so as to prevent strains which can result from excess movement of the various joints of the foot from the normal orientation. As a practical matter, this end cannot be fully achieved because of the competing demands of shoe flexibility and light weight, on the one hand, and the desirability to provide full support, on the other hand. Thus, athletes generally tape their feet to provide additional support when playing strenuous games. Various support structures for shoes and boots generally are well known, such as the spring structures shown in U.S. Pat. No. 450,698 issued, 1891, for an invention of Saunders; the stays show on U.S. Pat. No. 325,280 issued, 1885, for an invention of Smadbeck, et al., and the brace structures, such as shown in U.S. Pat. No. 1,441,677 issued 1923 for an invention of Golden. In addition, strap structures are shown in substantially rigid athletic shoes such as ski boots and ice skates, as shown in French Patent No. 827,130 published Apr. 25, 1938, for an invention of Selinger. Finally, it is known to provide an ankle support from a spring material and rising vertically from the sole with a cut out over the ankle bone for a tall shoe or boot as shown in U.S. Pat. No. 534,179 issued Feb. 12, 1895 for an invention of Sessler. While the foregoing patents show generally the use of stays, springs and straps to more firmly hold the foot in a given position, restrain excessive motion, or provide additional support, they do not provide optimal structures in face of the above competing demands.

SUMMARY OF THE INVENTION

The present invention provides for an athletic shoe that permits the wearer's ankle the leeway to flex forward and rearwards, but restrains the ankle from flexing laterally or medially, thereby providing the wearer with the optimum mix of flexibility and support. According to one embodiment of the present invention, an athletic shoe having a flexible sole and a high-top upper, which includes a foot portion affixed to the sole and an ankle (or high-top) portion, is provided with a medial strut device and a lateral strut device. The strut devices restrain the upper's ankle portion from flexing medially and laterally. The medial strut device is affixed such that it is substantially immovable with respect to the upper's foot portion, and is vertically aligned adjacent to the medial side of the upper's ankle portion, but is not affixed to the upper's ankle portion. The lateral strut device is affixed such that it is also substantially immovable with respect to the upper's foot portion and is vertically aligned adjacent to the lateral side of the upper's ankle portion, but is not affixed to the upper's ankle portion. The embodiment also includes a front fastener for connecting the medial strut device around the front of the upper's ankle portion to the lateral strut device. The embodiment further includes a rear fastener for connecting the medial strut device around the rear of the upper's ankle portion to the lateral strut device.

In one embodiment, the strut devices include a lower strut and an upper strut, wherein the lower and upper struts are pivotally connected in the region of the malleolus, such that the upper strut may be pivoted forward but not laterally or medially.

In another embodiment, the upper includes a counter, and the lateral and medial strut devices each include an integrally formed strut that is attached to the sole and to the counter and that crosses over the region of the malleolus.

In a preferred embodiment where the strut devices include integrally formed struts, the lateral strut is attached to the sole just behind the fifth metatarsal, is generally contoured to the anatomy of the wearer's ankle and is angled forward towards the front of the upper's ankle portion; and the medial strut passes over the region of the talus and angles forward towards the front of the ankle portion.

In a further preferred embodiment, the upper's ankle portion includes a relatively flexible rear neck portion that permits rear entry into the shoe.

BRIEF DESCRIPTION OF THE DRAWINGS

These and other features of the invention may be better understood by reference to the drawings in which.

DESCRIPTION OF SPECIFIC EMBODIMENTS

Figure 1:
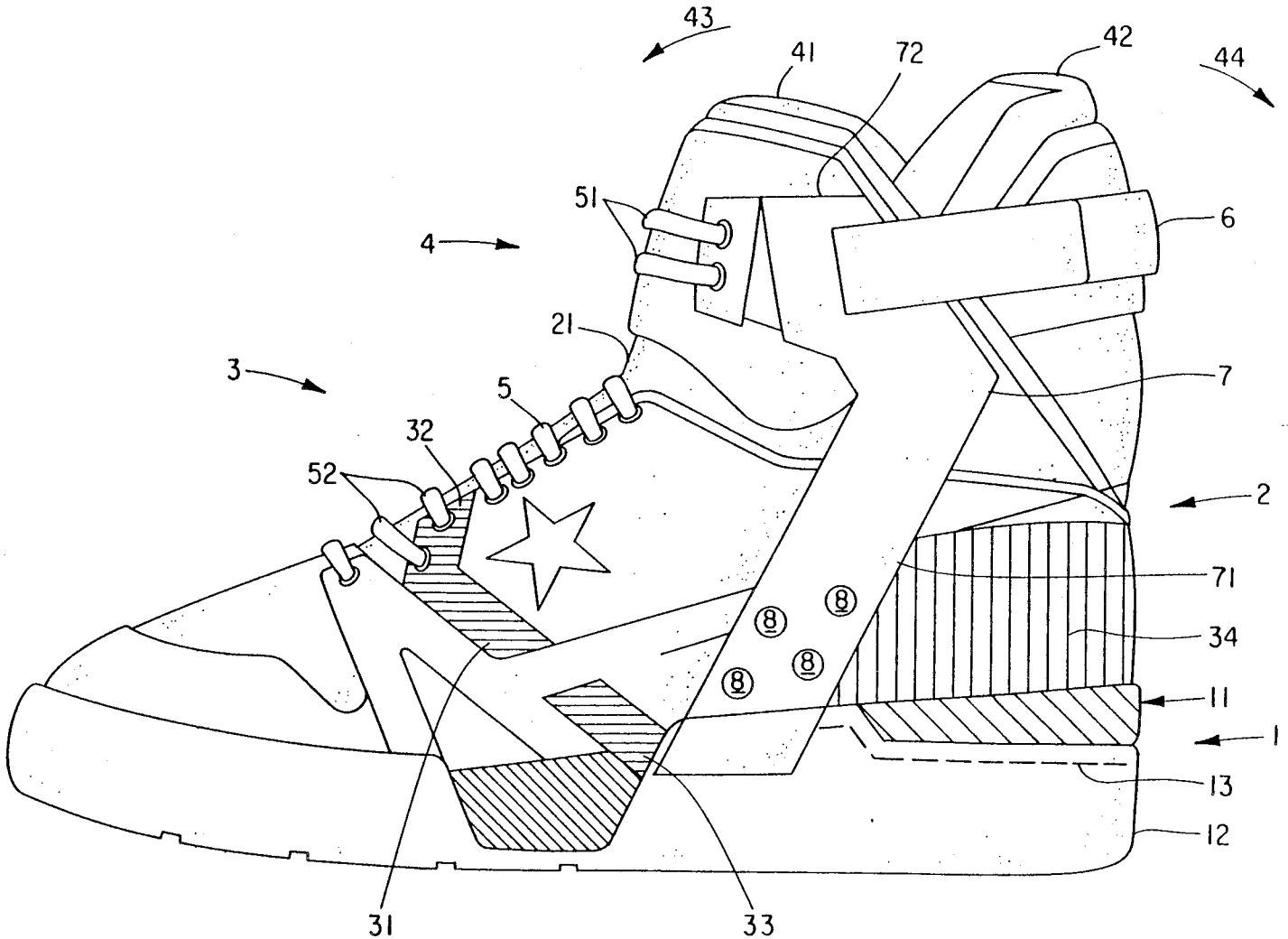
FIG. 1 is a lateral view of a preferred embodiment of a shoe according to the present invention.

FIG. 1 shows a lateral view of a shoe, in a preferred embodiment of the present invention showing a sole 1 and upper 2. The sole includes an outsole 12 and a midsole 11. The midsole 11 can be made out of a large variety of materials, such as polyurethane, that provide shock absorption. The upper includes two portions, a foot portion 3, which surrounds the foot, and an ankle or high-top portion, which surrounds the lower area of the shin and calf. The foot portion 3 includes a counter portion 34. The foot 3 and high-top 4 portions of the upper 2 meet in the general area of the malleolus joint. The connection between the high-top portion 4 and the foot portion 3 should be flexible enough to permit the ankle to flex forward and rearward. The high-top portion 4 has two semi-cylindrical parts, a front neck part 41 and a rear neck part 42. The rear neck part is flexibly joined to the foot portion 3 of the upper and can be pulled back and down to allow rear entry of the foot into the athletic shoe. Both the front neck part 41 and the rear neck part 42 can be cushioned for the comfort of the wearer. The embodiment shown in FIG. 1 does not have a tongue; rather it has a support fabric 21 that surrounds much of the foot and which is preferably made of a three-way stretch material, such as a fabric made of neoprene. However, the present invention has applicability to shoes with tongues and to shoes without separate front and rear neck parts.

FIG. 1 also shows an integrally formed strut 7 that is vertically aligned with the shoe. In the embodiment shown, the bottom end 71 of the strut is attached to the sole 1 by means of stitching 13 and is attached to the counter portion 34 of the upper 2 by means of rivets 8. Thus, the bottom end 71 of the strut is substantially immovable with respect to the foot portion 3 of the upper. The top end 72 of the strut 7 is located adjacent to the high-top portion 4 of the upper 2. The top end 72 of the strut is not connected to the ankle portion 4 of the upper, thereby allowing the high-top portion 4 to flex forward (as indicated by arrow 43) and rearwards (as indicated by arrow 44). However, the strut restrains the high-top portion 4 of the upper from flexing laterally and in conjunction with fasteners can restrain the high-top portion from flexing medially.

The strut 7 can be made in a wide variety of shapes. In a preferred embodiment, in order to increase the support and the comfort of the shoe, the struts are contoured to the anatomy of the wearer's ankle. FIG. 1 shows the lateral strut 7 being attached to the sole 1 just behind the region of the fifth metatarsal, and just in front of the protuberance on the calcaneous. The strut 7 angles back towards the region of the malleolus. From the general region of the malleolus, the strut 7 angles forward towards the front of the high-top portion 4 of the upper.

Figure 2:
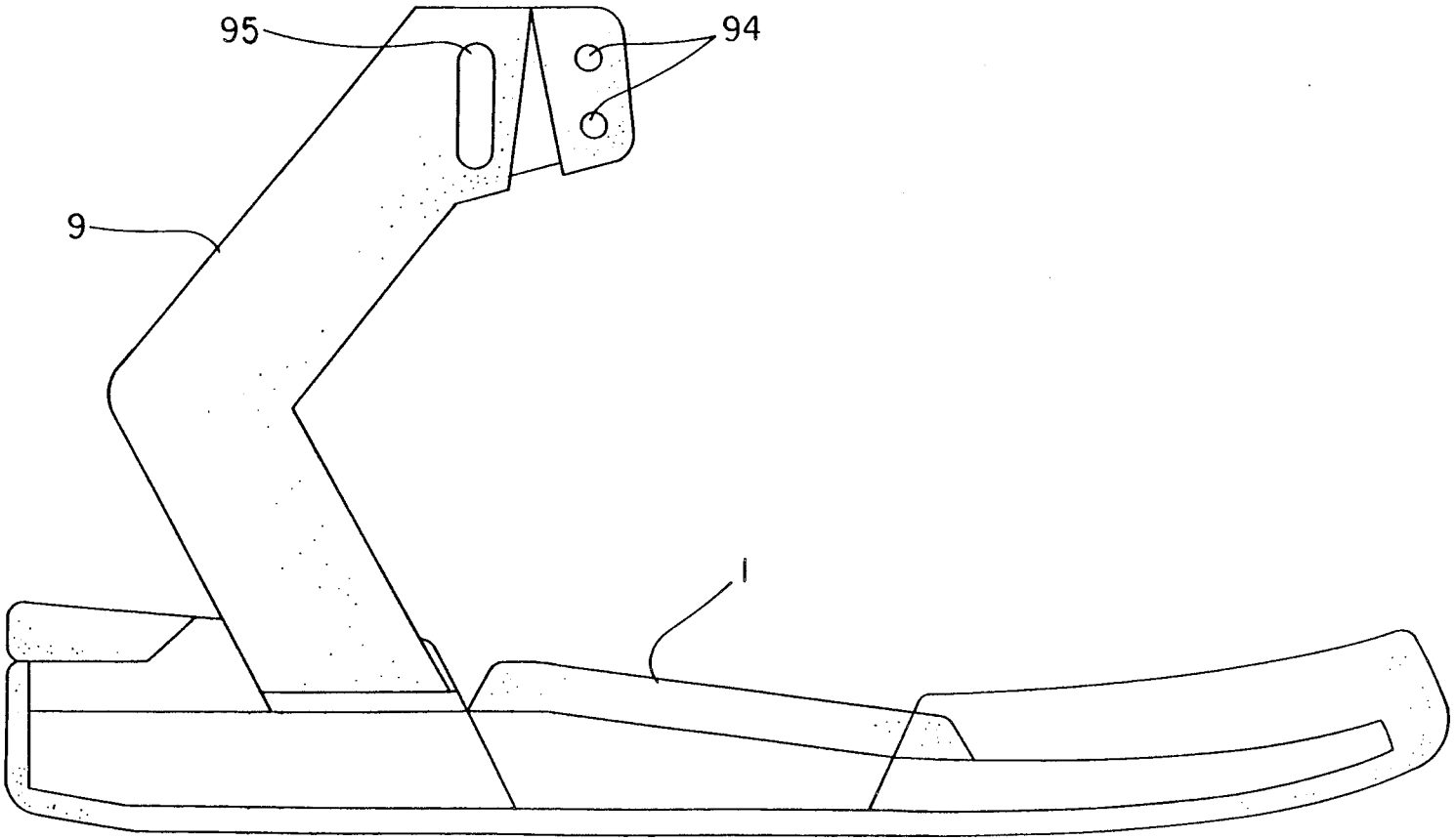
FIG. 2 is a medial view of a sole and a strut of a shoe according to the present invention.

FIG. 2 shows a medial view of the medial strut 9 attached to the sole 1. As shown in FIG. 2, the medial side of the shoe has a strut 9 similar to that of the lateral strut that can be similarly attached to the shoe such that the medial strut is also immovable with respect to the foot portion of the upper and such that the high-top portion 4 is free to flex forward and rearward The lateral and medial struts restrain the ankle from flexing medially and laterally. Ankle sprains are usually caused by overflexing medially and laterally, whereas forward and rearward flexing is generally safer.

Like the lateral strut the medial strut initially angles back and then forward as it goes up. In this particular embodiment, the strut 9 passes just behind the malleolus. FIG. 2 also shows two sets of apertures in the strut 9. Aperture 95 accepts a strap which passes around the rear of the shoe and connects the medial strut 9 to the lateral strut 7. Apertures 94 can accept laces which pass around the front of the ankle portion to connect the medial strut to the lateral strut. FIG. 1 shows the strap 6 and the laces 51. The laces 51 connecting the two struts can be part of the same lacing system 5 that is used to tighten the foot portion 3 of the upper. In lieu of laces 51, other means, such as another strap, can be used to connect the lateral and medial struts around the front. Likewise, means other than the strap 6 can be used to attach the lateral and medial struts around the rear of the shoe. In a preferred embodiment, strap 6 has hook and pile fasteners in order that the strap 6 can be tightened or loosened easily. The strap 6 (or other rear fastening means) and the laces 51 (or other front fastening means) provide additional, adjustable support to the ankle. Nevertheless, an appropriate amount of leeway forward 43 and rearward can be maintained.

The struts can be made out of a wide variety of rigid or semi-rigid materials. Rigid thermoplastics such as Hytrel by Dupont Company, Wilmington, Delaware, or fiber reinforced nylon are preferred. More flexible plastics, such as polyvinyl chloride blends can be used, and the resulting shoe may be more comfortable, but it will have less support than if the more rigid plastics were used.

FIG. 1 also shows a midfoot reinforcement 31. Uppers are typically made out of leather, which tends to stretch over time, conforming to the foot of the wearer and making the shoe more comfortable. However, too much stretch degrades the support provided by the upper. Thus, a reinforcement 31 that is made out of a flexible and relatively non-stretchable material can provide lasting support in key areas such as the mid-foot region. In the shoe depicted in FIG. 1, the lower end 33 of the reinforcement 31 is attached to the sole 1 in the mid-foot region, and the top end 32 has apertures for accepting laces 52. Preferably, the reinforcement 31 is stitched to the upper 2.

Figure 3:
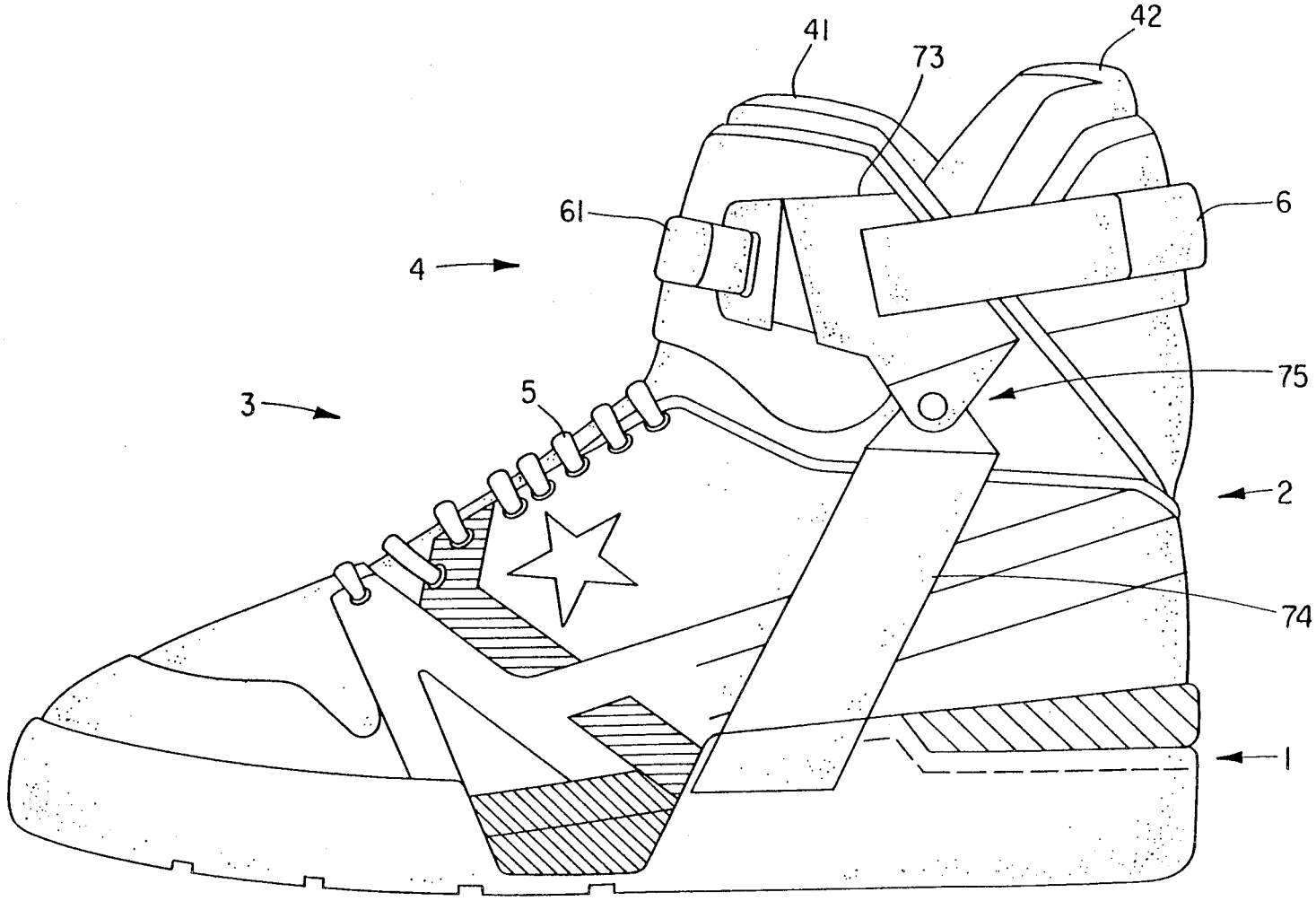
FIG. 3 is a lateral view of another embodiment of a shoe according to the present invention.

FIG. 3 shows an embodiment wherein the strut device includes a pivot 75. The strut device includes a lower strut 74 that is attached to the sole 1 and the foot portion 3 of the upper such that it is relatively immovable with respect to the upper. The strut device also includes an upper strut 73 that is aligned with the high-top portion 4 of the upper. The upper strut 73 is connected to lower strut 74 by a pivoting device 75, located in the region of the malleolus, that permits the upper strut 73 to pivot forward and rearward, but resists pivoting or flexing medially or laterally. The medial strut device has a similar structure with upper and lower struts pivotally connected. In the embodiment depicted in FIG. 3, the lateral and medial upper struts are connected by means of a rear strap 6 and a front strap 61. The pivot 75 provides the shoe depicted in FIG. 3 with a greater amount of forward and rearward flexibility than the shoe depicted in FIG. 1.

Because the shoe shown in FIG. 3 has strut devices that include pivots 75, the upper struts 73 can be affixed to the high-top portion 4 without completely sacrificing forward and rearward flexibility. This embodiment provides greater forward and rearward flexibility and the ability to attach the upper strut 73 to the high-top portion 4.

In another embodiment, the medial and lateral strut devices can be linked at their ends by means of a bar through the sole. Indeed, the lateral strut, the bar and the medial strut can be integrally formed such that a U-shaped structure is formed. Such a structure may provide even greater support.

Another embodiment of the invention includes a single strut device, either the medial strut or the lateral strut. For instance, a shoe comprising just the lateral strut of FIG. 1, but not the medial strut, in some situations may provide all the necessary support. In such a shoe a single fastener, for instance a strap, could be attached to the top of the strut and be wrapped around the circumference of the high-top portion. Thus, there is some leeway in forward and rearward flexibility, and medial and lateral flexing is relatively restrained.

We claim:

1. An improved athletic shoe of the type having a sole and an upper, wherein the upper is formed with lateral and medial side sheet portions having adjacent edges, each side portion having a counter portion, and sheet fastening means for fastening the lateral and medial side portions along a portion of the adjacent edges thereof together, and a structure, having first and second sheet springs each having an upper portion and a lower portion, the upper portion having an upper end, the structure being made of material which is resistant to both bending and twisting out of its plane and which is relatively unstretchable and incompressible in such plane, wherein each spring extends upward from the region of the sole and is attached thereto below the region of the ankle, each spring having fore and rear attachment points proximate to its upper end, and restraint fastening means for fastening under tension the corresponding pairs of fore and rear attachment points so as to form a structure for inhibiting displacement of the ankle, wherein the improvement comprises:

each spring being integrally formed and being generally contoured to the anatomy of the wearer's ankle, and the lower portion of the spring being conformably and rigidly fixed along substantially the entire perimeter of the spring that lies below the ankle to the counter portion of the lateral and medial sheet portions of the upper respectively, such that the upper portion of each spring above the ankle is unaffixed to the lateral and medial sheet portions of the upper allowing the upper portion of the spring to stand free of the side of the shoe.

2. An improved athletic shoe according to claim 1 wherein the restraint fastening means for fastening under tension is a first strap which attaches to the fore attachment points such as to restrain the front of the ankle and a second strap which attaches to the rear attachment points such as to restrain the back of the ankle so as to form, together with the upper portion, a structure for inhibiting such displacement.

3. An improved athletic shoe according to claim 2 further including cushioning means extending upward from above the ankle for protecting the leg from contact with the springs and extending around the rear of the shoe to form a collar.

4. An improved athletic shoe according to claim 1, wherein the restraint fastening means includes lace means for interconnecting the fore portions under tension.

5. An improved athletic shoe of the type having a sole and an upper, wherein the upper is formed with lateral and medial side sheet portions having adjacent edges, each side portion having a counter portion, and sheet fastening means for fastening the lateral and medial side portions along a portion of the adjacent edges thereof together, and a structure, having first and second sheet springs each having an upper portion and a lower portion, the upper portion having an upper end, the structure being made of material which is resistant to both bending and twisting out of its plane and which is relatively unstretchable and incompressible in such plane, wherein each spring extends upward from the region of the sole and is attached thereto below the region of the ankle, each spring having fore and rear attachment points proximate to its upper end, and restraint fastening means for fastening under tension the corresponding pairs of fore and rear attachment points so as to form a structure for inhibiting displacement of the ankle, wherein the improvement comprises:

each spring being V-shaped and positioned such that the spring is connected to the sole in front of the ankle and the point of the V is to the rear of the wearer's ankle, and each spring being generally contoured to the anatomy of the wearer's ankle and the lower portion of the spring is conformably and rigidly fixed along substantially the entire perimeter of the spring that lies below the ankle to the counter portion of the lateral and medial sheet portions of the upper respectively, such that the upper portion of each spring above the ankle is unaffixed to the lateral and medial sheet portions of the upper allowing the upper portion of the spring to stand free of the side of the shoe.

6. An improved athletic shoe according to claim 5 wherein the restraint fastening means for fastening under tension is a first strap which attaches to the fore attachment points such as to restrain the front of the ankle and a second strap which attaches to the rear attachment points such as to restrain the back of the ankle so as to form, together with the upper portion, a structure for inhibiting such displacement.

7. An improved athletic shoe according to claim 6 further including cushioning means extending upward from above the ankle for protecting the leg from contact with the springs and extending around the rear of the shoe to form a collar 8. An improved athletic shoe according to claim 5, wherein the restraint fastening means includes lace means for interconnecting the fore portions under tension.

9. An improved athletic shoe according to claim 5, wherein each of the springs is integrally formed.

10. An improved athletic shoe according to claim 9, wherein the fastening means includes lace means for interconnecting the fore attachment points under tension.

11. An improved athletic shoe according to claim 5, wherein each of upper portions of the springs is pivotally attached to its corresponding lower portion.

12. An improved athletic shoe of the type having a sole and an upper, wherein the upper is formed with lateral and medial side sheet portions having adjacent edges, each side portion having a counter portion, and sheet fastening means for fastening the lateral and medial side portions along a portion of the adjacent edges thereof together, wherein the improvement comprises:

a structure, having first and second lower springs made of material which is resistant to both bending and twisting out of its plane and which is relatively unstretchable and incompressible in such plane, wherein each lower spring is generally contoured to the anatomy of the wearer's ankle and extends upward from the region of the sole and is attached to the sole below the region of the ankle, and each lower spring is conformably and rigidly fixed along substantially the entire perimeter of the spring that lies below the ankle to the counter portion of the lateral and medial sheet portions of the upper respectively, the structure having first and second upper springs, each having an upper end, the springs being made of material which is resistant to both bending and twisting out of its plane and which is relatively unstretchable and incompressible in such plane, and pivotally attached to the first and second lower springs respectively for relative movement in the plane of the springs, each upper spring is unaffixed to the lateral and medial sheet portions of the upper allowing the upper portion of the spring to stand free of the side of the shoe and having fore and rear attachment points proximate to its upper end, and restraint fastening means for fastening under tension the corresponding pair of fore and rear attachment points so as to form a structure for inhibiting displacement of the ankle.

13. An improved athletic shoe according to claim 12 wherein the restraint fastening means for fastening under tension is a first strap which attaches to the fore attachment points such as to restrain the front of the ankle and a second strap which attaches to the rear attachment points such as to restrain the back of the ankle, so as to form, together with the upper portion, a structure for inhibiting such displacement.

14. An improved athletic shoe according to claim 13 further including cushioning means extending upward from above the ankle for protecting the leg from contact with the springs and extending around the rear of the shoe to form a collar.

* * * * *